US010247510B2

(12) United States Patent
Duford

(10) Patent No.: US 10,247,510 B2
(45) Date of Patent: Apr. 2, 2019

(54) COMPOSITE WHIP

(71) Applicant: JDD Products, LLC, Polson, MT (US)

(72) Inventor: James D. Duford, Polson, MT (US)

( * ) Notice: Subject to any disclaimer, the term of this patent is extended or adjusted under 35 U.S.C. 154(b) by 0 days.

(21) Appl. No.: 15/484,099

(22) Filed: Apr. 10, 2017

(65) Prior Publication Data

US 2017/0292807 A1 Oct. 12, 2017

Related U.S. Application Data

(60) Provisional application No. 62/320,683, filed on Apr. 11, 2016.

(51) Int. Cl.
*F41B 15/02* (2006.01)
*B68B 11/00* (2006.01)

(52) U.S. Cl.
CPC ..... *F41B 15/02* (2013.01); *B68B 11/00* (2013.01)

(58) Field of Classification Search
CPC ..... B68B 11/00; F41B 15/02
See application file for complete search history.

(56) References Cited

U.S. PATENT DOCUMENTS 297,006 A * 4/1884 Rand ..... B68B 11/00 231/2.1
815,458 A 3/1906 Morris
4,135,719 A 1/1979 Braunhut
4,456,255 A * 6/1984 Braunhut ..... F41B 15/025 231/2.1
4,460,174 A 7/1984 Perry
4,533,140 A 8/1985 Champion
4,631,770 A 12/1986 Goldberg
4,687,131 A 8/1987 Braunhut
5,149,092 A 9/1992 Parsons
5,295,926 A 3/1994 Tanabe
5,367,714 A 11/1994 Hines
5,372,363 A 12/1994 Siddle
6,089,449 A 7/2000 Butterworth

OTHER PUBLICATIONS http://www.coldsteel.com/42.html.

* cited by examiner

*Primary Examiner* — Dmitry Suhol
*Assistant Examiner* — Peter Iannuzzi
(74) *Attorney, Agent, or Firm* — Haffey Vap PLLC; Mitchell J. W. Vap

(57) ABSTRACT

The composite whip described herein relates to the fields of self-defense and personal protection tools. The present invention is compact, concealable, and easy to use. The present invention allows a user to strike quickly, repeatedly, and from a distance to repel would be attackers. The tensioning mechanism of the present invention allows the user to increase or decrease the flexibility of the striking portion of the tool based on the user's preferences. The present invention can be carried in a multitude of discreet locations, and is a non-lethal defensive option. The present invention could be utilized in other fields such as law enforcement, or military, where carrying hand-held, non-lethal, self-defense tools are necessary.

20 Claims, 4 Drawing Sheets

COMPOSITE WHIP

CROSS REFERENCE TO RELATED APPLICATIONS

This application claims the benefit of U.S. Pat. No. 6,232,068, filed on Apr. 11, 2016, which is fully incorporated by reference herein.

BACKGROUND OF THE INVENTION

1. Field of the Invention

The invention described herein relates to the fields of self-defense and personal protection tools. The present invention is compact, concealable, and easy to use. The present invention allows a user to strike quickly, repeatedly, and from a distance to repel would be attackers. The tensioning mechanism of the present invention allows the user to increase or decrease the flexibility of the striking portion of the tool based on the user's preferences. The present invention can be carried in a multitude of discreet locations, and is a non-lethal defensive option. This tool can be customized in length per user size and preference. The tool can also utilize various clips for additional attachments, and options for attachments to a multitude of locations, on or off the body. The present invention could be utilized in other fields such as law enforcement, or military, where carrying hand-held, non-lethal, self-defense tools are necessary.

2. Description of Related Art

Various examples of hand held self-defense tools exist in the prior art. For example, batons are often carried by law enforcement personnel. Generally, a baton is constructed in one piece, of a rigid material such as wood, or a metal alloy. A baton can be unwieldy to use, and require specific training for use. The weight of a baton can be prohibitive for smaller users who lack the strength to effectively use the baton. A one-piece baton is not a practical means for personal self-defense since such tools cannot be carried easily and discreetly.

Telescoping batons can be carried more discreetly; however, the telescoping feature of such batons can be prone to malfunction, and material fatigue. Furthermore, deploying a telescoping baton requires the user to wield the baton, and deploy the telescoping portion of the baton before it can be used effectively. Lastly, telescoping batons, in their deployed state are not adjustable as to their rigidity.

Spring whips utilize interconnected lengths of springs to form the striking portion of the tool. Such a design provides for some flexibility in the striking portion of the tool. However, like a baton, no means to adjust the rigidity of the tool exists. Furthermore, spring whips and telescoping varieties of spring whips have the same problems generally associated with batons, which have been described above.

3. Objects of the Present Invention

Due to the issues discussed above, there is a need for an improved, customizable, more discreet, and easy to use self-defense tool. One object of the present invention is to provide a self-defense tool that is light-weight and easy to utilize. Another object of the present invention is to provide a self-defense tool with a tensioning mechanism that can increase or decrease the stiffness of the striking portion of the tool. Another object of the present invention is to provide a self-defense tool that can be discreetly carried in a variety of positions on the body. Yet another object of the present invention is to provide a self-defense tool that can be quickly deployed without reliance on telescoping mechanisms. Another object of the present invention is to provide a self-defense tool that has interchangeable striking ends. Yet another object of the present invention is to provide a self-defense tool, with customizable attachment means and additional utility modifications available.

SUMMARY OF THE INVENTION

The subject invention solves the problems outlined above. The subject invention is a composite whip with adjustable tensioning, which can be utilized by anyone for self-defense. The simple and lightweight design of the subject invention allows anyone to deliver a defensive strike to a would-be attacker simply by swinging their arm or wrist while grasping the handle of the subject invention.

One novel feature of the subject invention is the tensioning mechanism, which can be utilized to make the striking portion of the composite whip more, or less flexible based upon the user's preference and method of carry. The design of the subject invention allows it to be carried discreetly on various parts of the body and drawn extremely quickly to fend off would be attackers. For example, the subject invention can be slid inside of clothing and clipped to the waistline of a pair of pants. Or, tension of the subject invention can be decreased, and it can be threaded through belt loops to conform to the user's waist contour, and clipped onto a belt loop. When carried in this manner, the user only needs to grasp the handle and draw the tool for immediate use. No retrieval from a handbag, telescoping, or special skills are required for the tool to be utilized for self-defense.

The tensioning mechanism will also affect the reactiveness and striking force of the composite whip. As more tension is applied, the striking portion of the composite whip becomes stiffer. A stiffer striking portion will have a faster reaction speed and deliver more force to the object being struck. Conversely, a more flexible striking portion will be less reactive, and deliver less force to the object being struck The subject invention is comprised of a proximal handle, which can be constructed of a multitude of materials. The handle of the embodiment described herein is constructed of high impact nylon. The handle is gripped by the user to swing the composite whip. An outer support tube extends distally from the interior of the handle casing, which provides support to the proximal portion of the whip outer sleeve. Both the outer support tube and whip outer sleeve can be constructed of any flexible material. The outer support tube and whip outer sleeve of the embodiment described herein are constructed of flexible vinyl.

At the distal striking end of the whip outer sleeve is a distal tensioning sleeve. The distal tensioning sleeve can be constructed with interior threads, which can accept interchangeable striking tips. The standard distal tensioning sleeve does not contain interior threading. The distal tensioning sleeve is generally constructed of stainless steel; however, any multitude of materials could be used to construct the distal tensioning feature of the present invention. The distal tensioning sleeve of the present invention provides a distal tensioning anchor by holding the distal weld ball of the inner cable. The inner cable can be any material suitable to withstand significant bending forces while under tension. The inner cable of the embodiment described herein, is a stainless-steel cable.

During assembly, the inner cable is inserted into the distal tensioning sleeve and whip outer sleeve, which have been pre-inserted into the outer support tube. The distal weld ball is then seated within the distal tensioning sleeve. Once the distal weld ball is seated within the distal tensioning sleeve, the tensioning mechanism is then assembled. The tensioning mechanism provides the proximal tensioning anchor, and means to adjust the stiffness of the striking portion of the present invention. The tensioning mechanism can be made of any material capable of withstanding significant tensile force without deformation. The means of providing the proximal and distal tensioning anchors can be accomplished in a multitude of ways including but not limited to crimping, gluing, pinning, staking, or spot welding. The means of providing the tensioning mechanism can also be accomplished in a multitude of ways including but not limited to utilization of springs, levers, binding devices, or notches.

The tensioning mechanism described in the embodiment herein is constructed of stainless-steel. To assemble the tensioning mechanism, a threaded inner sleeve is slid onto the proximal end of the inner cable. The distal end of the threaded inner sleeve butts up against the proximal end of the whip outer sleeve. The threaded inner sleeve then accepts a threaded outer sleeve which is used to increase or decrease tension of the inner cable.

Once the threaded outer sleeve is fully rotated on to the threaded inner sleeve, a proximal weld ball is created by TIG welding the proximal end of the inner cable. The embodiment described herein utilizes TIG welding of the stainless-steel inner cable to create the proximal and distal weld balls which create the anchors necessary to allow tensioning of the inner cable.

In the present embodiment, tension of the inner cable is created by rotating the outer threaded sleeve on the threaded inner sleeve as shown in FIG. 7. The outer threaded sleeve pushes against the proximal weld ball while the distal weld ball is anchored in place by the distal tensioning sleeve, which results in a stretching force applied to the length of the inner cable as shown in FIG. 7. Tensioning of the inner cable results in the striking portion of the composite whip being more stiff and reactive. Decreasing the tension of the inner cable results in the composite whip being more flexible.

It should be noted that the preferred embodiment includes the tensioning mechanism described herein; however, the tensioning mechanism could be excluded in other embodiments. In such embodiments, the tensioning mechanism could be replaced by a proximal tensioning sleeve, in which the proximal weld ball of the inner cable would be seated. Such an embodiment would exhibit all the features discussed above, except for the ability to adjust the tension of the inner cable, and thus the stiffness of the striking portion of the composite whip.

The proximal end of the outer sleeve and tensioning mechanism seat within a molded groove of each half of the handle. The halves of the handle are secured together by a plurality of screws and corresponding nuts, which hold the proximal end and tensioning mechanism securely in place. The handle, also features a striking end at the proximal end of the handle. Accessory holes and/or clips can be utilized on the handle for various attachment means of the subject invention to essentially any conceivable attachment point. The handle portion of the subject invention could also be modified to contain other utility features such as knives, sprays, lights or electric shock mechanisms.

DETAILED DESCRIPTION OF THE PREFERRED EMBODIMENTS

Although only one embodiment is explained in detail, the figures and specifications should be understood as illustrations only, and are not intended to limit the invention in its scope. Also, in describing the embodiment, specific terminology may be used, but it should be understood that specific terms include all technical equivalents that operate in similar manners to accomplish similar purposes.

Figure 9:
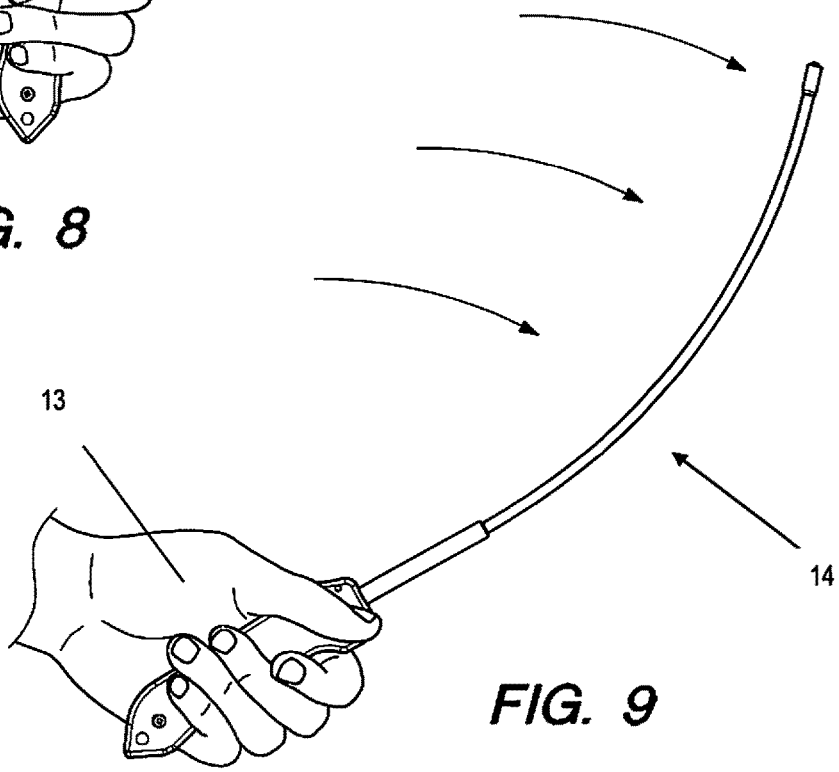
FIG. 9 is a perspective view of reaction of composite whip during use.

With reference to the drawings, a preferred embodiment of the composite whip is illustrated in the attached drawings. The preferred embodiment of the composite whip is depicted in FIG. 9. The preferred embodiment of the composite whip with adjustable tensioning is comprised of a proximal handle 1, which is gripped by the user 13 to swing the composite whip 14. An outer support tube 2 extends distally from the interior of the handle 1 casing, which provides support to the proximal portion of the whip outer sleeve 3.

At the distal striking end of the whip outer sleeve 3 is a distal tensioning sleeve 4, which can be threaded to accept interchangeable striking tips 5. The standard distal tensioning sleeve 4 is unthreaded. The distal tensioning sleeve 4 holds the distal weld ball 6 of the inner cable 7. During assembly, the inner cable 7 is inserted into the distal tensioning sleeve 4 and whip outer sleeve, which have been pre-inserted into the outer support tube 2. The distal weld ball 6 is then seated within the distal tensioning sleeve 4. Once the distal weld ball 6 is seated within the distal tensioning sleeve 4, the tensioning mechanism 16 is then assembled. To assemble the tensioning mechanism 16, a threaded inner sleeve 8 is slid onto the proximal end of the inner cable 7. The distal end of the threaded inner sleeve 9 butts up against the proximal end of the whip outer sleeve 10. The threaded inner sleeve 8 then accepts a threaded outer sleeve 11 which is used to increase or decrease tension of the inner cable 7.

Figure 1:
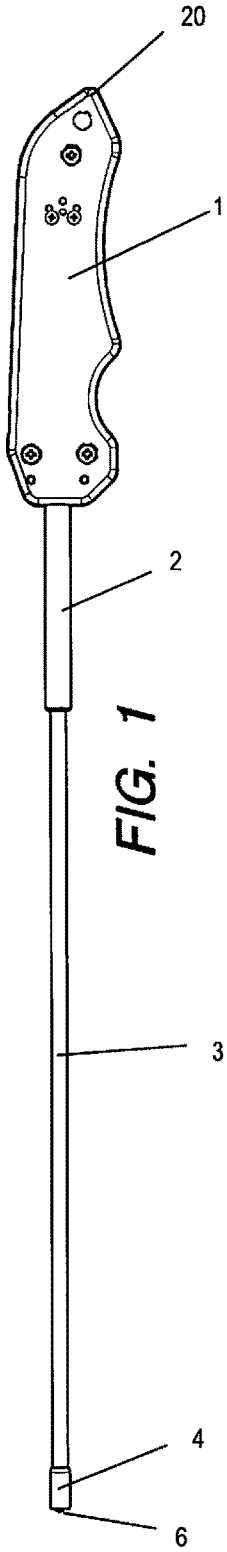
FIG. 1 is a side view of the composite whip.
Figure 2:
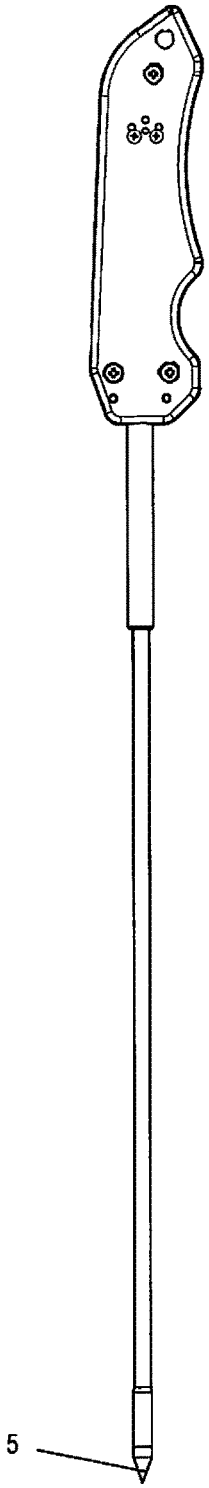
FIG. 2 is a side view of the composite whip with pointed striking tip attached at distal striking end.
Figure 3:
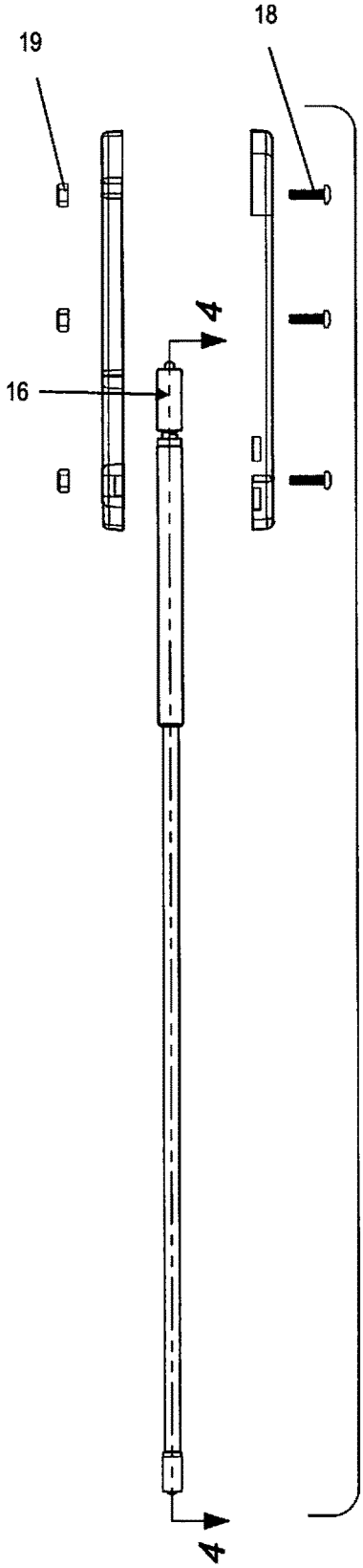
FIG. 3 is a top view of the composite whip, handle unassembled showing tensioning mechanism.
Figure 4:
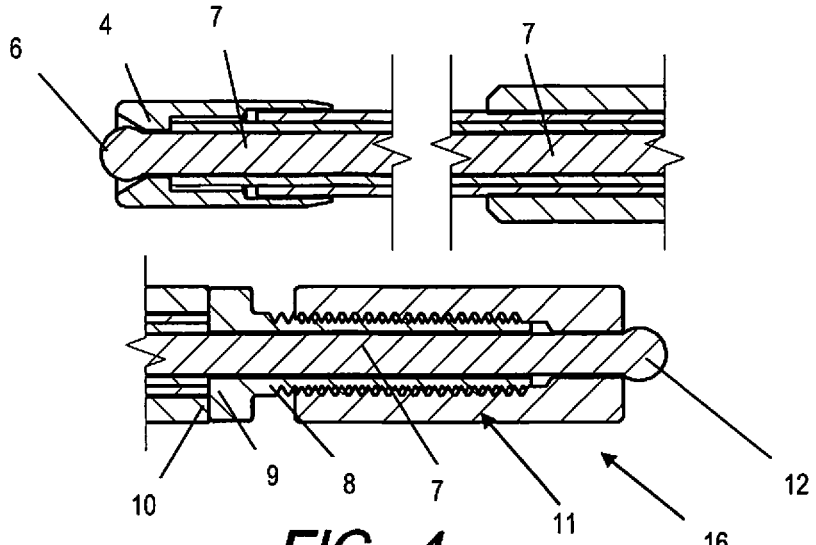
FIG. 4 is a side cut away view of distal striking end with standard distal tensioning sleeve and proximal end tensioning mechanism.
Figure 5:
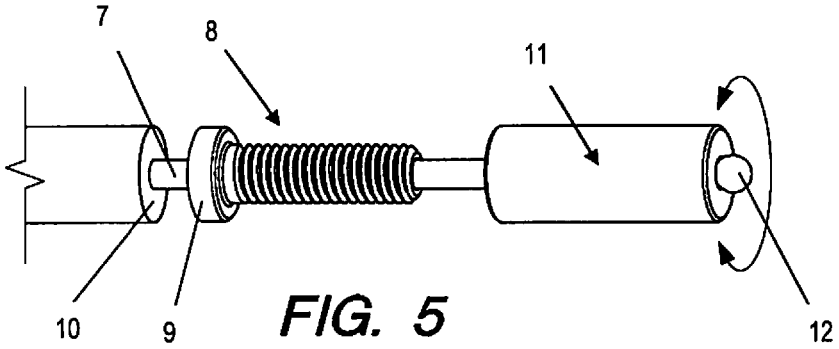
FIG. 5 is a perspective view of unassembled inner cable tensioning mechanism.
Figure 6:
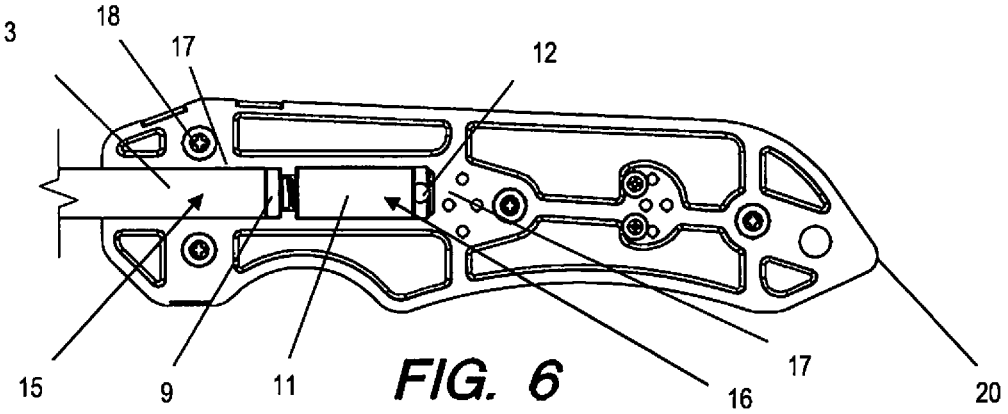
FIG. 6 is a side view of assembled proximal end tensioning mechanism in handle casing.
Figure 7:
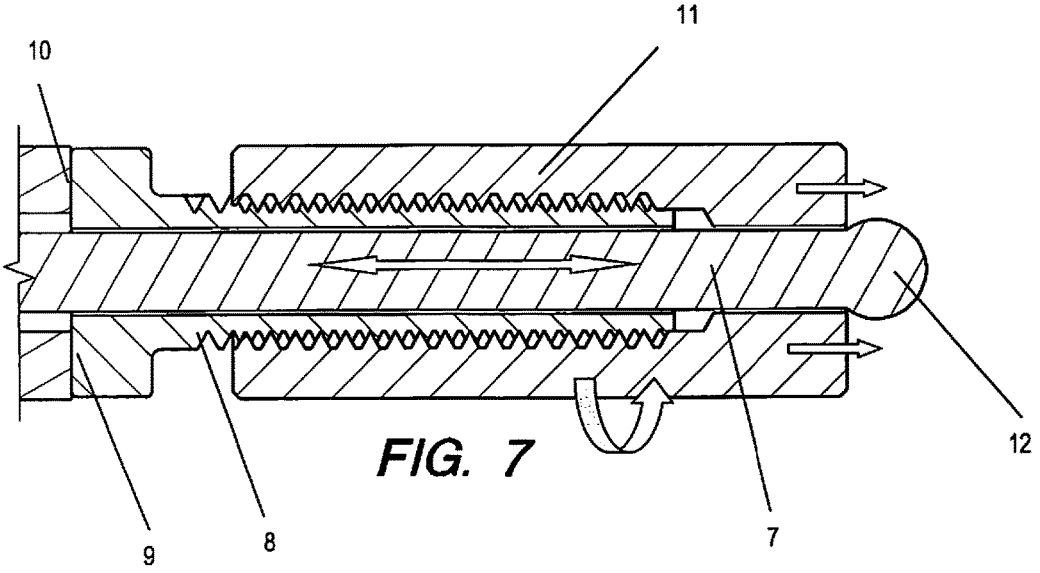
FIG. 7 is a blow-up, side cut-away view of proximal tensioning mechanism.
Figure 8:
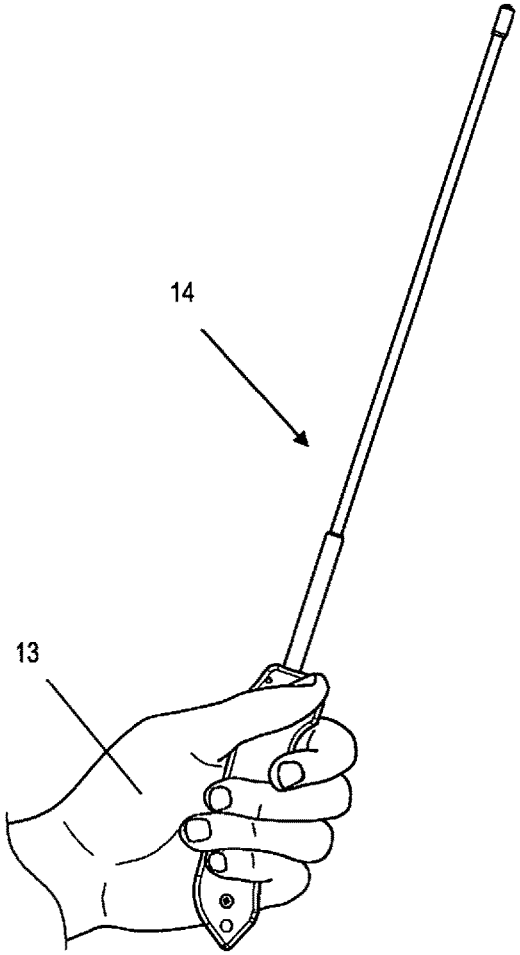
FIG. 8 is a perspective view of user gripping the composite whip.

Once the threaded outer sleeve 11 is fully rotated on to the threaded inner sleeve 8, a proximal weld ball 12 is created by TIG welding the proximal end of the inner cable 7. Tension of the inner cable 7 is created by counter-rotating the outer threaded sleeve 11 on the threaded inner sleeve 8 as shown in FIG. 7. The outer threaded sleeve 11 pushes against the proximal weld ball 12 while the distal weld ball 6 is anchored in place by the distal tensioning sleeve 4, which results in a stretching force applied to the length of the inner cable 7 as shown in FIG. 7. Tensioning of the inner cable 7 results in the composite whip 14 being more stiff and reactive. Decreasing the tension of the inner cable 7, results in the composite whip being more flexible.

The proximal end 15 and tensioning mechanism 16 of the composite whip 14 seat within a molded groove 17 of each half of the handle 1. The halves of the handle 1 are secured together by a plurality of screws 18 and corresponding nuts 19, which hold the proximal end 15 and tensioning mechanism 16 securely in place. The handle 1, also features a striking end 20 at the proximal end of the handle 1.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein.

I claim:

1. A composite whip comprising:

(a) a handle;

(b) an outer sleeve connected to said handle, where said outer sleeve extends distally from the interior of said handle;

(c) an inner cable within said outer sleeve;

(d) a distal anchor, which anchors said inner cable to the distal end of said outer sleeve; and (e) an anchor, which anchors said inner cable to the proximal end of said outer sleeve.

2. The composite whip of claim 1, where said distal anchor accepts interchangeable tips.

3. The composite whip of claim 1, where said handle further comprises a proximal pointed striking end.

4. The composite whip of claim 1, where the proximal portion of said outer sleeve is supported by an outer support tube, which extends distally from the interior of said handle.

5. The composite whip of claim 1, where said distal anchor is further comprised of a distal tensioning sleeve.

6. The composite whip of claim 5, where the distal end of said inner cable is comprised of a weld ball seated within said distal tensioning sleeve.

7. The composite whip of claim 6, where the proximal anchor is further comprised of a proximal tensioning sleeve.

8. The composite whip of claim 7, where the proximal end of said inner cable is comprised of a weld ball seated within said distal tensioning sleeve.

9. A composite whip with adjustable tensioning comprising:

(a) a handle;

(b) an outer sleeve connected to said handle, where said outer sleeve extends distally from the interior of said handle where the proximal portion of said outer sleeve is supported by an outer support tube, which extends distally from the interior of said handle;

(c) an inner cable within said outer sleeve;

(d) a distal tensioning anchor, which anchors said inner cable to the distal end of said outer sleeve;

(e) a tensioning mechanism proximal to said distal tensioning anchor;

(f) a tensioning anchor proximal to said tensioning mechanism, which said tensioning mechanism pushes against to increase tension of said inner cable.

10. The composite whip with adjustable tensioning of claim 9 where said distal tensioning anchor accepts interchangeable tips.

11. The composite whip with adjustable tensioning of claim 9, where said handle further comprises a pointed proximal striking end.

12. The composite whip with adjustable tensioning of claim 9, where the proximal portion said outer sleeve is supported by an outer support tube, which extends distally from the interior of said handle.

13. The composite whip with adjustable tensioning of claim 9, where said distal tensioning anchor is further comprised of a distal tensioning sleeve.

14. The composite whip with adjustable tensioning of claim 13, where the distal end of said inner cable is comprised of a weld ball seated within said distal tensioning sleeve.

15. The composite whip with adjustable tensioning of claim 9, where said tensioning mechanism further comprises:

a. a threaded inner sleeve slid onto the proximal end of said inner cable;

b. a threaded outer sleeve, which is rotated onto said inner sleeve; and c. a weld ball at the proximal end of said inner cable, which said threaded outer sleeve pushes against to increase tension of said inner cable.

16. The composite whip with adjustable tensioning of claim 13, where said tensioning mechanism further comprises:

a. a threaded inner sleeve slid onto the proximal end of said inner cable;

b. a threaded outer sleeve, which is rotated onto said inner sleeve; and c. a weld ball at the proximal end of said inner cable, which said threaded outer sleeve pushes against to increase tension of said inner cable.

17. A composite whip with adjustable tensioning comprising:

(a) a handle;

(b) an outer sleeve connected to said handle, where said outer sleeve extends distally from the interior of said handle;

(c) an inner cable within said outer sleeve;

(d) a distal tensioning anchor, which anchors said inner cable to the distal end of said outer sleeve;

(e) where said distal tensioning anchor is further comprised of a distal tensioning sleeve;

(f) where the distal end of said inner cable is comprised of a weld ball seated within said distal tensioning sleeve;

(g) a tensioning mechanism proximal to said distal tensioning anchor;

(h) where said tensioning mechanism further comprises:

a threaded inner sleeve slid onto the proximal end of said inner cable;

a threaded outer sleeve, which is rotated onto said inner sleeve; and a weld ball at the proximal end of said inner cable, which said threaded outer sleeve pushes against to increase tension of said inner cable.

18. The composite whip with adjustable tensioning of claim 17 where said distal tensioning anchor accepts interchangeable tips.

19. The composite whip with adjustable tensioning of claim 17, where said handle further comprises a pointed proximal striking end.

20. The composite whip with adjustable tensioning of claim 17, where the proximal portion of said outer sleeve is supported by an outer support tub, which extends distally from the interior of said handle.

* * * * *